US008368510B2

(12) United States Patent
Luckhardt

(10) Patent No.: US 8,368,510 B2
(45) Date of Patent: Feb. 5, 2013

(54) BIOMETRIC AUTHENTICATION AND VERIFICATION

(76) Inventor: George William Luckhardt, San Diego, CA (US)

( * ) Notice: Subject to any disclaimer, the term of this patent is extended or adjusted under 35 U.S.C. 154(b) by 0 days.

(21) Appl. No.: 13/417,206

(22) Filed: Mar. 10, 2012

(65) Prior Publication Data

US 2012/0218074 A1 Aug. 30, 2012

Related U.S. Application Data

(63) Continuation of application No. 12/218,604, filed on Jul. 16, 2008, now Pat. No. 8,159,328.

(51) Int. Cl.
*G08B 21/00* (2006.01)

(52) U.S. Cl. ..... 340/5.82; 340/5.83; 340/5.52; 340/5.53; 382/115; 382/124; 713/182; 713/185

(58) Field of Classification Search ..... 340/5.82, 340/5.83, 5.52, 5.53; 382/115, 124; 713/182, 713/186; 356/326
See application file for complete search history.

(56) References Cited

U.S. PATENT DOCUMENTS

| | | | |
|---|---|---|---|
| 6,898,299 | B1 | 5/2005 | Brooks |
| 2001/0011680 | A1 | 8/2001 | Soltesz et al. |
| 2002/0035542 | A1 | 3/2002 | Tumey et al. |
| 2002/0091937 | A1 | 7/2002 | Ortiz |
| 2003/0048175 | A1 | 3/2003 | Wang et al. |
| 2004/0162984 | A1 | 8/2004 | Freeman et al. |
| 2004/0230488 | A1 | 11/2004 | Beenau et al. |

OTHER PUBLICATIONS

Mobile Transactions and Commerce, Webpage http://mobilecommercesummit.ca/conference/detailed agenda, 2012.
Ravi Das, Multimodal Biometric Solutions, Keesing Journal of Documents and Identity, Issue 23, 2007, pp. 12-14.
Mobeel, MobbID, Webpage http://www.mobbeel.com, 2012.
Google, 2-Step Verification, Webpage http://support.google.com/a/bin/answer, 2012.
Google, Accounts, Webpage http://www.support.google.com/a/bin/answer, 2012.
Privaris, Biometric Software Security Systems, Webpage http://privaris.com/biometric_software.html, 2012.
Find Biometrics, Global Identity Management, Webpage http://www.findbiometrics.com/biometrics-security, 2012.

*Primary Examiner* — Jennifer Mehmood
*Assistant Examiner* — Mark Rushing
(74) *Attorney, Agent, or Firm* — George W Luckhardt

(57) ABSTRACT

Biometric authentication and verification are described. A method in biometric identification includes establishing a foundational biometric measurement based on a first user input. The method also includes providing a second user input at a biometric terminal, the second user input used by the biometric terminal to determine whether to acknowledge a verifying biometric measurement, in response to receipt of the established foundational biometric measurement and the second user input. The method may also include establishing the foundational biometric measurement, by the user, utilizing biometric equipment. Alternatively, the establishing of the foundational biometric measurement based on first user input is performed by providing the first user input to a biometric kiosk, the biometric kiosk using the first user input to establish the foundational biometric measurement. Advantages of the present invention include the ability to perform more secure biometric transactions.

15 Claims, 5 Drawing Sheets

BIOMETRIC AUTHENTICATION AND VERIFICATION

CROSS-REFERENCE TO RELATED APPLICATIONS

This application is a continuation of, claims priority to, and wholly incorporates by reference U.S. patent application Ser. No. 12/218,604, filed on Jul. 16, 2008, now granted as U.S. Pat. No. 8,159,328 to Luckhardt.

FIELD

The invention relates generally to biometric identification and, more specifically, to biometric authentication and verification.

BACKGROUND

Biometrics refers to the collection, synthesis, analysis and management of quantitative data on biological communities, such as forests. More recently, biometrics have come to include the study of methods for uniquely recognizing humans based upon one or more intrinsic physical or behavioral traits. Behaviometrics refers to behavioral biometrics such as typing rhythm, gait, signature, keystrokes or mouse gestures, where the analysis may be performed continuously, without interfering with user activities.

Biometrics may be used to identify an input sample, when it is compared to a template, thus identifying specific people by certain characteristics. The user's identity may be authenticated in any one of three ways: by something the user knows (such as a password or personal identification number), by something the user has (a security token or smart card) or by an attribute of the user himself (a physical characteristic, such as a fingerprint, called a biometric), or by something related to the behavior of a person (a behaviometric, such as signature, keystroke dynamics and voice). Strictly speaking, voice is also a physiological trait because every person has a different pitch, but voice recognition is mainly based on the study of the way a person speaks, and thus is commonly classified as behavioral.

Standard biometric validation systems often use multiple inputs of samples for sufficient validation, such as particular characteristics of the sample. This intends to enhance security as multiple different samples are required such as security tags and codes and sample dimensions.

The various biometrics are compared to determine if a human characteristic may be used for particular biometric application. The criteria for comparison may likely include:

- Universality —each person should have the characteristic.
- Uniqueness —how well the biometric separates individually from another.
- Permanence —measures how well a biometric resists aging.
- Collectibility —ease of acquisition for measurement.
- Performance —accuracy, speed, and robustness of technology used.
- Acceptability —degree of approval of a technology.
- Circumvention —ease of use of a substitute.

TABLE 1A, below, shows a comparison of existing biometric systems in terms of the above criteria. (Modified from Jain, A. K.; Ross, Arun & Prabhakar, Salil (January 2004), "An introduction to biometric recognition", *IEEE Transactions on Circuits and Systems for Video Technology* 14th (1): 4-20) A. K. Jain ranks each biometric based on the categories as being either low, medium, or high. A low ranking indicates poor performance in the evaluation criterion whereas a high ranking indicates a very good performance.

TABLE 1A

| BIOMETRICS: | Universality | Uniqueness | Permanence | Collectibility | Performance | Acceptability | Circumvention* |
|---|---|---|---|---|---|---|---|
| Face | H | L | M | H | L | H | L |
| Fingerprint | M | H | H | M | H | M | H |
| Hand geometry | M | M | M | H | M | M | M |
| Keystrokes | L | L | L | M | L | M | M |
| Hand veins | M | M | M | M | M | M | H |
| Iris | H | H | H | M | H | L | H |
| Retinal scan | H | H | M | L | H | L | H |
| Signature | L | L | L | H | L | H | L |
| Voice | M | L | L | M | L | H | L |
| Facial thermograph | H | H | L | H | M | H | H |
| Odor | H | H | H | L | L | M | L |
| DNA | H | H | H | L | H | L | L |
| Gait | M | L | L | H | L | H | M |
| Ear Canal | M | M | H | M | M | H | M |

(H = High, M = Medium, L = Low)

*Note:

under "Circumvention" column, "Low" is desirable, instead of "High."

Additionally, to attempt to raise security level, two separate mechanisms may be used together in a process called two-factor authentication. Two-factor authentication, however, typically requires costly changes to hardware and infrastructure. Therefore, biometric security is usually relegated to a single authentication method.

Hence, although much is known about various biometrics that may be used for authentication purposes, delivery of heightened biometric security without adding significant encumbrances to the user/retailer/building operator, etc., is still needed.

SUMMARY

Accordingly, the present invention is directed to biometric authentication and verification.

In one embodiment, a method in biometric identification, includes establishing a foundational biometric measurement based on a first user input, and providing a second user input at a biometric terminal, the second user input used by the biometric terminal to determine whether to acknowledge a verifying biometric measurement, in response to receipt of the established foundational biometric measurement and the second user input. The establishing of the foundational biometric measurement based on the first user input may be substantially performed by the user, utilizing biometric equipment. Alternatively, the establishing of the foundational biometric measurement based on the first user input may be performed by providing the first user input to a biometric kiosk, the biometric kiosk using the first user input to establish the foundational biometric measurement. The method may further include expiring the foundational biometric measurement based on passage of a set period of time since establishment, regardless of whether there has been an acknowledgement of the verifying biometric measurement. The method may further comprise validating a user transaction request at the biometric terminal in response to an acknowledgement of a corresponding verifying biometric measurement. Additionally, the method may further include allowing the user to complete a current transaction, in response to the validating of the user transaction request. The set period of time may be preset by one or more of the following: the user; a financial institution associated with the user; a credit institution associated with the user; a law enforcement or government agency; or a credit reporting agency In another embodiment, a handheld biometric device includes an authentication/establishment module, configured to receive a first user input, the first user input to be used to establish a foundational biometric measurement. The handheld biometric device also includes a verifying biometric measurement module, configured to enable the user to provide second user input to a biometric terminal, in order that the verifying biometric measurement might be acknowledged in response to receipt of the established foundational biometric measurement and the second user input. The handheld biometric device also includes a communications module, configured to facilitate communications between the handheld biometric device and a biometric terminal or biometric kiosk. Furthermore, the handheld biometric device includes a processor and memory, configured to enable the handheld wireless device to perform operations related to biometric identification. The foundational biometric measurement may be established, based on the first user input, at least in response to utilization of biometric equipment is by the user. Alternatively, the foundational biometric measurement is established, based on the first user input, at least in response to the first user input being provided to a biometric kiosk, the biometric kiosk using the first user input to establish the foundational biometric measurement. The foundational biometric measurement may expire based on passage of a set period of time since establishment, regardless of whether there has been a successful acknowledgement of a verifying biometric measurement. A user transaction request is validated at the biometric terminal in response to acknowledgement of a corresponding verifying biometric measurement. The foundational biometric measurement may be selected from at least one of a set of high performance biometrics, consisting of a fingerprint, an iris scan, a retinal scan, or a DNA reading. The verifying biometric measurement may be selected from at least one of a set of high collectibility biometrics, consisting of facial geometry, hand geometry, signature analysis, facial thermograph, or gait.

In yet another embodiment, a system for biometric identification comprises a handheld biometric device, configured to receive a first user input used to determine whether to establish a fundamental biometric measurement. The system also includes a biometric terminal, configured to receive the established fundamental biometric measurement from the handheld device, and also to receive a second user input from the user, and to determine whether to acknowledge a verifying biometric measurement based on the established fundamental biometric measurement and the second user input. The foundational biometric measurement may be established, based on the first user input, at least in response to utilization of biometric equipment is by the user. Alternatively, the foundational biometric measurement may be established, based on the first user input, at least in response to the first user input being provided to a biometric kiosk, the biometric kiosk using the first user input to establish the foundational biometric measurement. The foundational biometric measurement may expire based on passage of a set period of time since establishment, regardless of whether there has been a successful acknowledgement of a verifying biometric measurement. A user transaction request may be validated at the biometric terminal in response to acknowledgement of a corresponding verifying biometric measurement. The set period of time may be preset by one or more of the following: the user; a financial institution associated with the user; a credit institution associated with the user; a law enforcement or government agency; or a credit reporting agency. The system may further include at least one communication link to facilitate communication between the handheld biometric device, the biometric terminal, and at least one backbone network.

Advantages of the present invention include providing more secure biometric authentication and verification. Additional advantages of the present invention may also include performing the more secure operation without requiring large capital investment by users and biometric terminal owners for new equipment.

BRIEF DESCRIPTION OF THE INVENTION

The accompanying drawings, which are included to provide a further understanding of the invention and are incorporated in and constitute a part of this application, illustrate embodiments of the invention and together with the description serve to explain the principles of the invention.

FIGS. 1A-C are flow diagrams illustrating methods for biometric authentication and verification, according to embodiments of the present invention;

DETAILED DESCRIPTION OF THE INVENTION

Figure 1A:
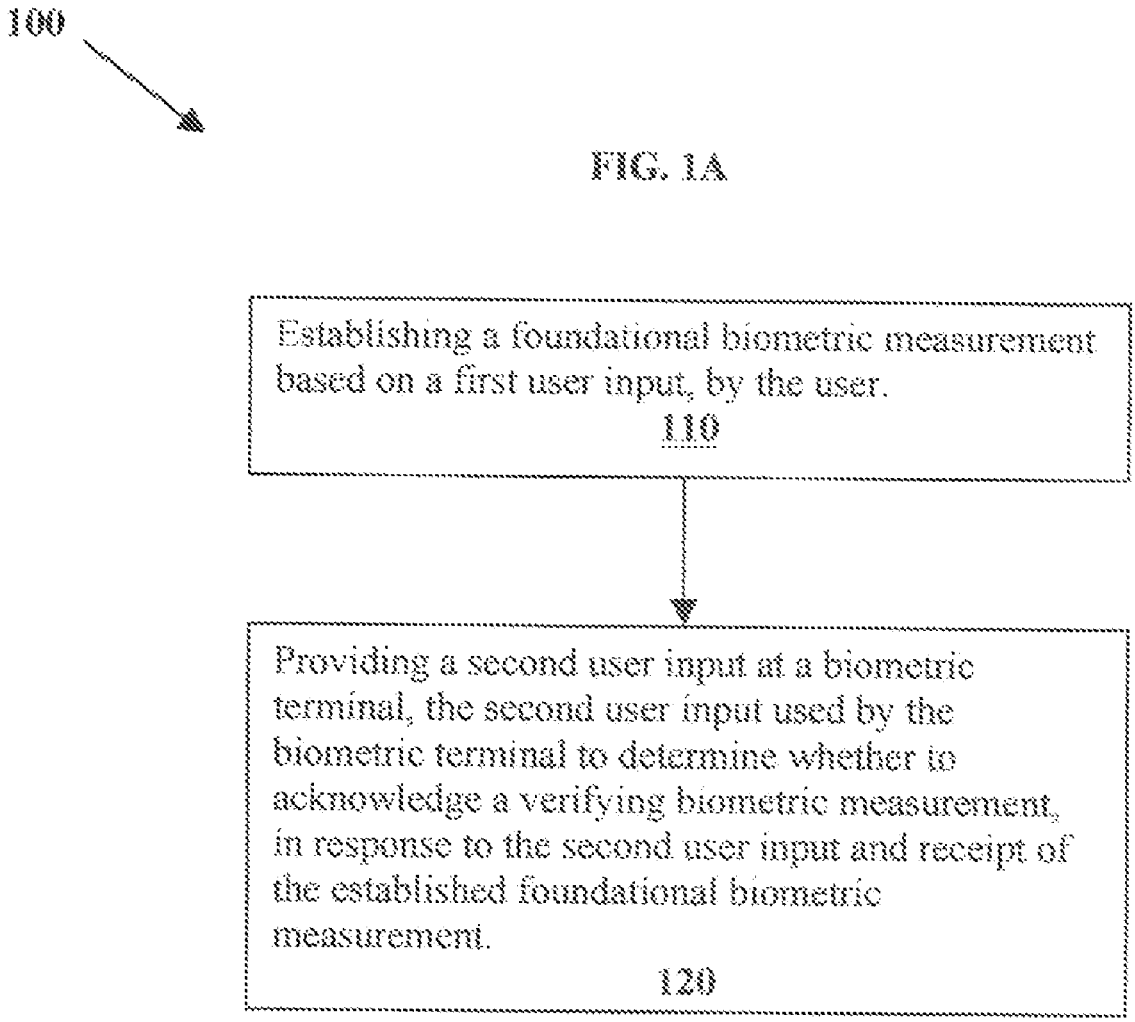

Reference will now be made in detail to the preferred embodiments of the present invention, examples of which are illustrated in the accompanying drawings. Wherever possible, the same reference numbers will be used throughout the drawings to refer to the same or like parts.

Biometric authentication and verification allows for heightened biometric security, that does not add significant encumbrances to the user/vendor/retailer/airport/train station/building operator, etc. In a step of authentication or foundation, the user takes or has taken a biometric measurement. This biometric measurement may be taken at the user's home (using collection equipment provided with a handheld biometric device, for example), or a biometric kiosk, for example, to provide the foundational biometric measurement. The foundational biometric measurement may be a "high performance" biometric (such as Fingerprint, Iris, Retinal Scan or DNA, for example). When this foundational biometric measurement is received and recognized, it is thereby established. Then, if the user is utilizing a handheld biometric device for biometric security purposes, the handheld biometric device may be set to an "Active" state. Once in the Active state, the user may later approach a second biometric terminal, such as a point of sale (POS) terminal, or the entrance to a secured building, for example. Because the foundational biometric measurement has been recognized and the handheld biometric device has been placed on Active state, the user, via his handheld biometric device or some other form of contact with a biometric terminal, is eligible to have a second biometric measurement taken at the biometric terminal. The biometric terminal validates that the foundational biometric measurement has been established, and then performs the additional or second biometric measurement. When this second biometric measurement is received and recognized, it is acknowledged as a verifying biometric measurement. Thus, when the established foundational biometric measurement and the verifying biometric measurement are both present with respect to the user, the user's handheld biometric device, and the biometric terminal, then the "transaction" may be approved for the user. This transaction may, again, take place at a POS terminal, a secured building entrance, or any other type of biometric terminal. The verifying biometric measurement may be a "high collectibility" biometric (such as facial image, hand geometry, signature, facial thermograph, gait, for example). In the case of POS terminals, for example, the specific high collectibility biometric that is collected may depend on the hardware available at the retail establishment/POS terminal. The high collectibility biometric to be collected may also be randomly determined so that the user does not know in advance which biometric will be collected at the POS, thereby further increasing the security handheld biometric device, and the overall biometric authentication system. Alternatively, the foundational biometric measurement may utilize a high collectibility biometric, and the verifying biometric measurement may utilize a high performance biometric. The decision on which way to configure the biometrics would at least partially depend on which party (e.g., user or POS terminal operator) was intended to receive the greatest ease of use from the system. For example, if the POS operator is required to take a highly collectible biometric measurement, this would be easier than taking a high performance biometric measurement. Furthermore, using the handheld biometric device, the user may quickly move through the POS terminal area, without sacrificing security. Regarding a transaction a biometric terminal, when the biometric terminal receives a "transaction request" from the handheld biometric device, if the biometric terminal is able to acknowledge the verifying biometric measurement, the biometric terminal issues a "validation of transaction request" to the handheld biometric device.

Those of ordinary skill in the art will appreciate that the foundational biometric measurement is established before, in time, the verifying biometric measurement is acknowledged. In one aspect, a defined time period is set, such that there is a maximum amount of time that may pass between the establishing of the foundational biometric measurement and the acknowledging of the verifying biometric measurement. The defined time period may be set by a user, or bank or creditor to the user, for example. In one aspect, the user, bank, or creditor may define certain criteria for the biometric authentication and verification, in addition to the time period for expiration, such as for example, whether the verifying biometric measurement is biometric or non-biometric.

The handheld biometric device described herein may offer a high level of convenience to the consumer. The handheld biometric device enables the consumer to conduct commercial transactions, such as at a point of service (POS) terminal, in a similar way to a credit card. However, the handheld biometric device may also contain various account information, such as bank account information, credit account information, and investment account information. The handheld biometric device may also contain personal information, such as department of motor vehicle (DMV) information, Passport, Visa, or Immigration status, and work and/or school status information, for example. Additionally, the handheld biometric device may be equipped to carry out commercial transactions in more than country, and with more than one currency or monetary unit, such as US Dollar, Great Britain Pound, Euro, Japanese Yen, etc. In other words, the handheld biometric device may currency-independent and/or capable of handling multiple currency types and/or monetary unit types. This "universal" nature of the handheld biometric device further highlights the need for the heightened biometric security described herein.

The handheld biometric device may connect by wired or wireless connection to a biometric terminal or kiosk. Furthermore, the handheld biometric device may be integrated into another handheld electronic device, such as a PDA, palm-top computer, email device, music and entertainment device, gaming device, or phone. Alternatively, it may be embodied in a conventional "credit card" format. It shall be understood by those of ordinary skill in the art, that the phrase 'handheld biometric device' is not limited to devices that are actually 'handheld'. Rather, the device may be roughly the size of an adult human hand, but may, in practice, be substantially larger or smaller than said adult human hand. The connections related to the biometric device, biometric terminal and/or biometric kiosk may be made over wired or wireless, public or private, free or paid networks, such as the Internet, Ethernet or an Intranet, for example. These networks may act as "backbone" or utility networks for communicating results of the biometric authentication and verification operations described herein.

In the present multi-modal biometric configuration if, for example, the foundational biometric measurement is established in the morning, and then the handheld biometric device is stolen that same day by a thief, the verifying biometric measurement must still be acknowledged before any biometric transactions may take place, such as at a secured building. In one example, the thief would need to know user authentication information, such as a password or smart card, for example, which the thief is unlikely to know. Alternatively, the verifying biometric measurement may also be biometric authentication, such as hand geometry, for example. Therefore the possibility that the thief will pass the verifying biometric measurement and receive acknowledgement is highly unlikely. Furthermore, since the foundational biometric user authentication must likely be reestablished at the specified interval, e.g. the next morning, there is an absolute cap on how long the fraud may be perpetrated. Furthermore, when the biometric handheld device is stolen, once known, the user may report the theft to a central administrator. The central administrator then issues "decline" orders to the network, so that transactions using the biometric handheld device are rejected and preferably so that the thief/fraudulent user is detained for arrest. Furthermore, if the centralized system of biometric terminals detects unusual transaction attempts or multiple biometric measurement failures, "decline" orders are also may be disseminated.

Regarding the biometric terminals and the biometric kiosks, they may be connected to a central server, via a wired and/or wireless connection. The central server may include a processor for biometric and non-biometric authentication and verification, as well as a memory. The memory may house a database of user biometric information, as well as information on fraudulent users of the system.

Referring now to FIG. 1A, at box 110, a foundational biometric measurement is established by the user, based on a first user input. At box 120, a second user input is provided at a biometric terminal, the second user input used by the biometric terminal to determine whether to acknowledge a verifying biometric measurement, in response to the second user input and receipt of the established foundational biometric measurement.

Figure 1B:
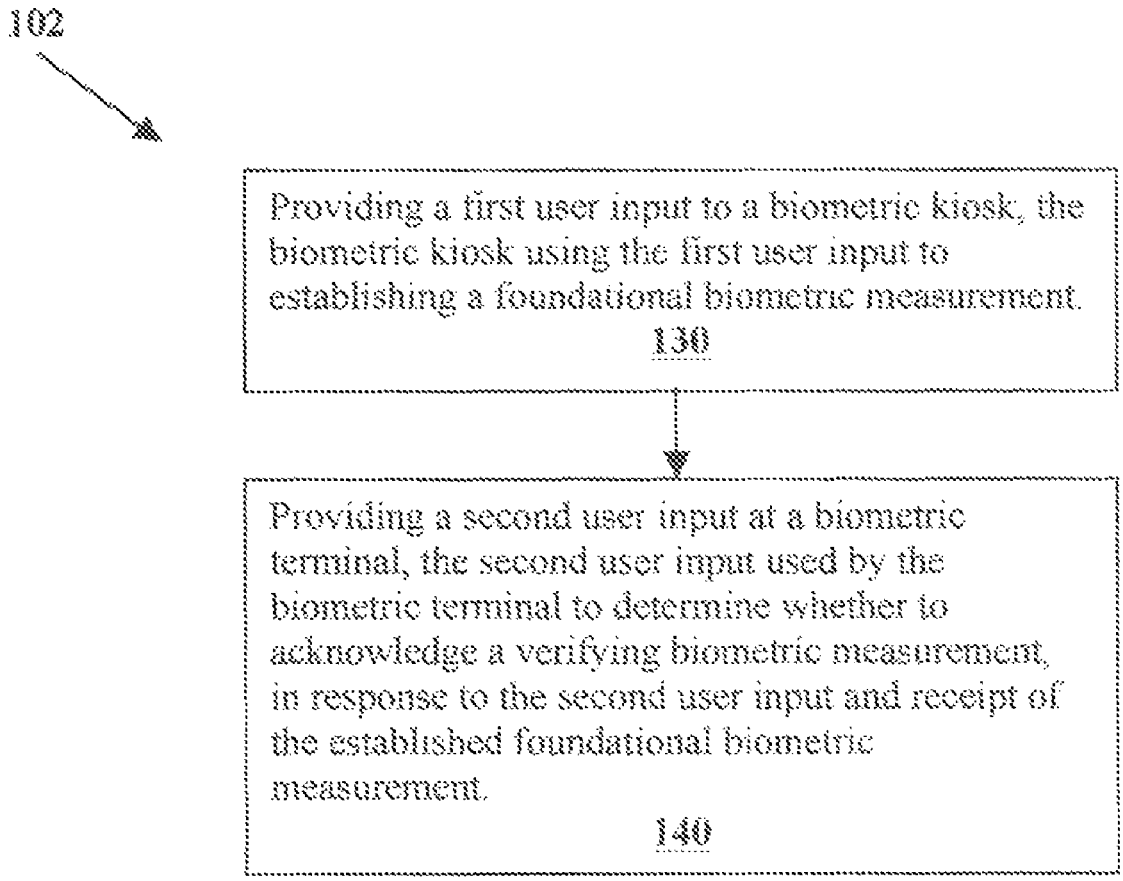

Referring now to FIG. 1B, at box 130, a first user input is provided to a biometric kiosk, the biometric kiosk using the first user input to establish a foundational biometric measurement. At box 140, a second user input is provided at a biometric terminal, the second user input used by the biometric terminal to determine whether to acknowledge a verifying biometric measurement, in response to the second user input and receipt of the established foundational biometric measurement.

Figure 1C:
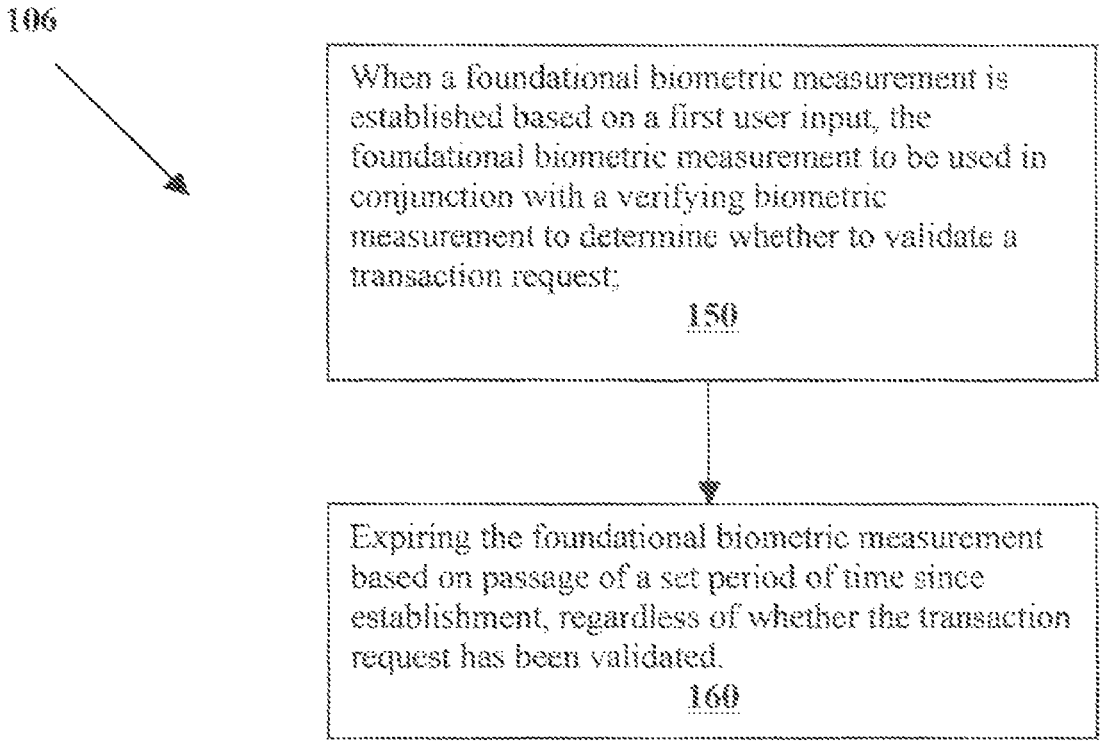

Referring now to FIG. 1C, at block 150, when a foundational biometric measurement is established based on a first user input, the foundational biometric measurement to be used in conjunction with a verifying biometric measurement to determine whether to validate a transaction request; at block 160, the foundational biometric measurement is expired based on passage of a set period of time since establishment, regardless the transaction has been validated.

Figure 2:
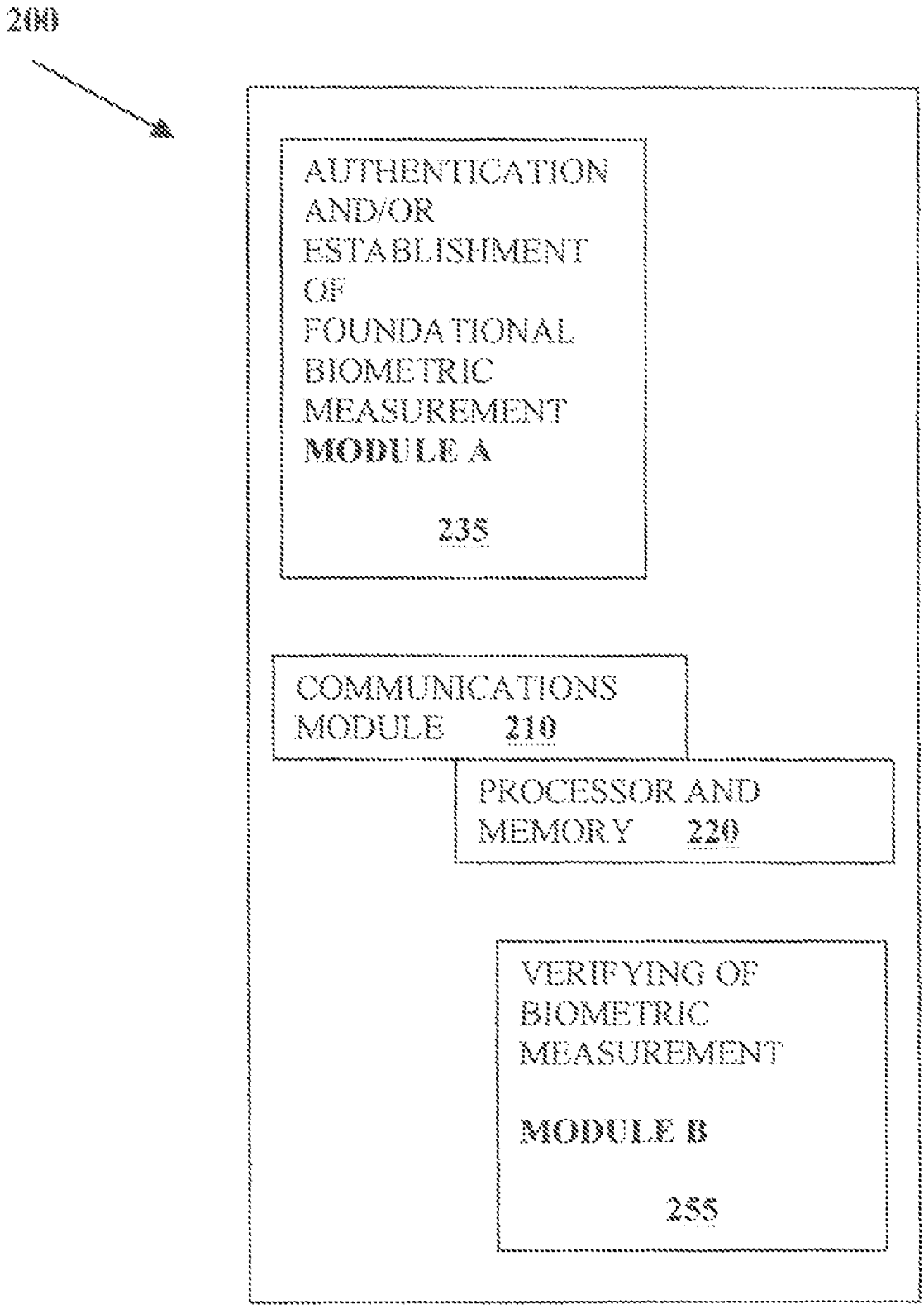
FIG. 2 is a block diagram illustrating an exemplary handheld device for use in conjunction with the methods for biometric authentication and verification described with reference to FIGS. 1A-C, according to embodiments of the present invention.
Figure 3:
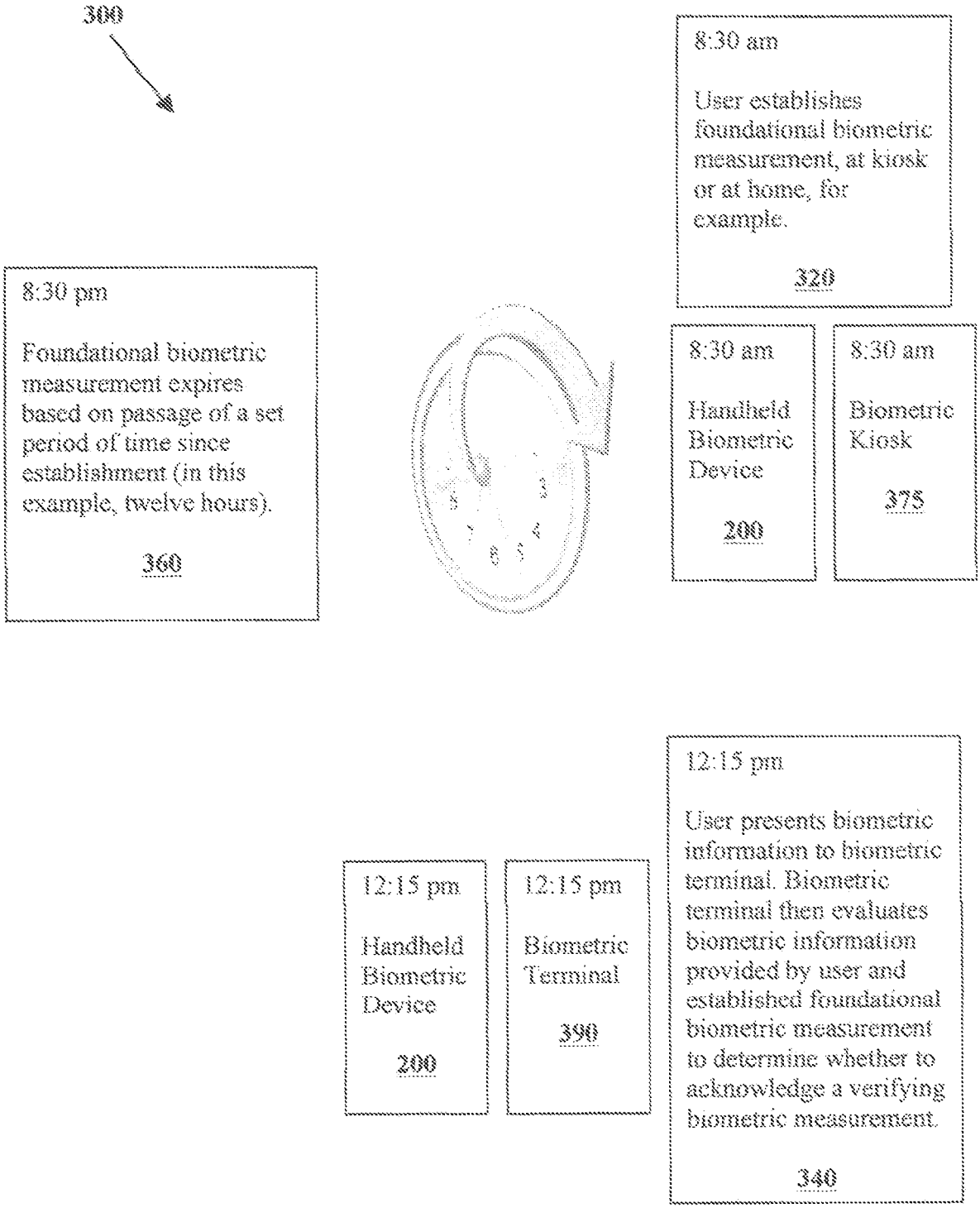
FIG. 3 is a block diagram illustrating a system for performing the methods of the present invention, operating in an exemplary environment and utilizing an exemplary handheld device, such as the one described with reference to FIG. 2, according to embodiments of the present invention.

Referring now to FIG. 2, a handheld biometric device 200 includes an authentication/establishment Module A configured to establish a foundational biometric measurement, or to contribute to the establishment of the foundational biometric measurement. The handheld biometric device 200 also includes a communications module 210 to facilitate communications between the handheld biometric device 200, the biometric kiosk, the biometric terminal, and the appropriate networks. The handheld biometric device 200 also includes a processor and memory 220, to enable the handheld biometric device 200 to perform computations and operations related to biometric identification. The handheld biometric device 200 also includes a verifying biometric measurement Module B configured to at least contribute to the acknowledging of the verifying biometric measurement.

Furthermore, in one embodiment, a method in biometric identification, includes establishing a foundational biometric measurement based on a first user input, and providing a second user input at a biometric terminal, the second user input used by the biometric terminal to determine whether to acknowledge a verifying biometric measurement, in response to receipt of the established foundational biometric measurement and the second user input. The establishing of the foundational biometric measurement based on the first user input may be substantially performed by the user, utilizing biometric equipment. Alternatively, the establishing of the foundational biometric measurement based on the first user input may be performed by providing the first user input to a biometric kiosk, the biometric kiosk using the first user input to establish the foundational biometric measurement. The method may further include expiring the foundational biometric measurement based on passage of a set period of time since establishment, regardless of whether there has been an acknowledgement of the verifying biometric measurement. The method may further comprise validating a user transaction request at the biometric terminal in response to an acknowledgement of a corresponding verifying biometric measurement. Additionally, the method may further include allowing the user to complete a current transaction, in response to the validating of the user transaction request. The set period of time may be preset by one or more of the following: the user; a financial institution associated with the user; a credit institution associated with the user; a law enforcement or government agency; or a credit reporting agency In another embodiment, a handheld biometric device includes an authentication/establishment module, configured to receive a first user input, the first user input to be used to establish a foundational biometric measurement. The handheld biometric device also includes a verifying biometric measurement module, configured to enable the user to provide second user input to a biometric terminal, in order that the verifying biometric measurement might be acknowledged in response to receipt of the established foundational biometric measurement and the second user input. The handheld biometric device also includes a communications module, configured to facilitate communications between the handheld biometric device and a biometric terminal or biometric kiosk. Furthermore, the handheld biometric device includes a processor and memory, configured to enable the handheld wireless device to perform operations related to biometric identification. The foundational biometric measurement may be established; based on the first user input, at least in response to utilization of biometric equipment is by the user. Alternatively, the foundational biometric measurement is established, based on the first user input, at least in response to the first user input being provided to a biometric kiosk, the biometric kiosk using the first user input to establish the foundational biometric measurement. The foundational biometric measurement may expire based on passage of a set period of time since establishment, regardless of whether there has been a successful acknowledgement of a verifying biometric measurement. A user transaction request is validated at the biometric terminal in response to acknowledgement of a corresponding verifying biometric measurement. The foundational biometric measurement may be selected from at least one of a set of high performance biometrics, consisting of a fingerprint, an iris scan, a retinal scan, or a DNA reading. The verifying biometric measurement may be selected from at least one of a set of high collectibility biometrics, consisting of facial geometry, hand geometry, signature analysis, facial thermograph, or gait.

In yet another embodiment, a system for biometric identification comprises a handheld biometric device, configured to receive a first user input used to determine whether to establish a fundamental biometric measurement. The system also includes a biometric terminal, configured to receive the established fundamental biometric measurement from the handheld device, and also to receive a second user input from the user, and to determine whether to acknowledge a verifying biometric measurement based on the established fundamental biometric measurement and the second user input. The foundational biometric measurement may be established, based on the first user input, at least in response to utilization of biometric equipment is by the user. Alternatively, the foundational biometric measurement may be established, based on the first user input, at least in response to the first user input being provided to a biometric kiosk, the biometric kiosk using the first user input to establish the foundational biometric measurement. The foundational biometric measurement may expire based on passage of a set period of time since establishment, regardless of whether there has been a successful acknowledgement of a verifying biometric measurement. A user transaction request may be validated at the biometric terminal in response to acknowledgement of a corresponding verifying biometric measurement. The set period of time may be preset by one or more of the following: the user; a financial institution associated with the user; a credit institution associated with the user; a law enforcement or government agency; or a credit reporting agency. The system may further include at least one communication link to facilitate communication between the handheld biometric device, the biometric terminal, and at least one backbone network.

Advantages of the present invention include providing more secure biometric authentication and verification. Additional advantages of the present invention may also include performing the more secure operation without requiring large capital investment by users and biometric terminal owners for new equipment.

It will be apparent to those skilled in the art that various modifications and variations may be made in the present invention without departing from the spirit or scope of the inventions. Thus, it is intended that the present invention covers the modifications and variations of this invention provided they come within the scope of the appended claims and their equivalents.

The invention claimed is:

1. A method in biometric identification, comprising:

establishing a foundational biometric measurement based on a first user input;

setting a period of time since establishment that indicates when the foundational biometric measurement is to expire, in response to the first user input;

providing a second user input, the second user input used to determine whether to acknowledge a verifying measurement, in response to receipt of the established foundational biometric measurement and the second user input;

validating a user transaction request at a biometric terminal if a corresponding verifying measurement is acknowledged;

allowing the user to complete a current transaction, if the user transaction request is validated;

and expiring the foundational biometric measurement based on passage of the set period of time since establishment, regardless of whether there has been a successful acknowledgement of a verifying measurement;

wherein the first user input and second user input are inputted by a user;

wherein allowing the user to complete a current transaction comprises allowing access to at least one of various information; and wherein the establishing of the foundational biometric measurement based on the first user input is performed by the user, utilizing biometric equipment.

2. The method of claim 1, wherein the verifying measurement is non-biometric.

3. The method of claim 1, wherein the current transaction involves a currency and the currency used in the current transaction is selected from a plurality of currency types.

4. A handheld biometric device, comprising:

an authentication/establishment module, configured to receive a first user input, the first user input to be used to establish a foundational biometric measurement;

a verifying measurement module, optionally configured to enable a user to provide second user input to a biometric terminal, in order that the verifying measurement might be acknowledged in response to receipt of the established foundational biometric measurement and the second user input;

a communications module, configured to facilitate communications between the handheld biometric device and a biometric terminal or biometric kiosk;

and a processor and memory, configured to enable the handheld biometric device to perform operations related to biometric identification;

wherein the foundational biometric measurement is established, based on the first user input, at least in response to the first user input being provided to a biometric kiosk, the biometric kiosk using the first user input to establish the foundational biometric measurement;

wherein the first user input and second user input are inputted by the user;

wherein a period of time since establishment is set, based on the first user input, to indicate when the foundational biometric measurement is to expire;

wherein the foundational biometric measurement expires based on passage of the set time period since establishment, regardless of whether there has been a successful acknowledgement of a verifying measurement;

wherein the authentication/establishment module is configured to establish another foundational biometric measurement after expiration, in response to another first user input;

wherein validation of a user transaction request at the biometric terminal occurs when there is an acknowledgement of a corresponding verifying measurement;

wherein the user is allowed to complete a current transaction, if the user transaction request is validated before the foundational biometric measurement expires;

wherein the user being allowed to complete a current transaction comprises allowance of access to at least one of various information to the user; and wherein the foundational biometric measurement is established, based on the first user input, at least in response to utilization of biometric equipment by the user.

5. The handheld biometric device of claim 4, wherein whether the verifying measurement is biometric or non-biometric is defined by at least one of the group consisting of the user, a bank, a financial institution, a creditor, a credit reporting agency, a vendor, a retailer, an airport, a train station, a building operator, a credit institution, a law enforcement agency, and a government agency.

6. The handheld biometric device of claim 4, wherein the biometric terminal is a terminal selected from the group consisting of a point of sale (POS) terminal, an entrance to a secured building, bank terminal, a credit terminal, a vendor terminal, a retail terminal, an airport security terminal, a train station security terminal, a law enforcement agency terminal, and a government agency terminal.

7. The handheld biometric device of claim 4, wherein the current transaction involves a currency and the currency used in the current transaction is selected from a plurality of currency types.

8. The handheld biometric device of claim 4, wherein the at least one of various information to which the user is allowed access is selected from the group consisting of bank account information, credit account information, investment account information, and personal information.

9. The handheld biometric device of claim 4, wherein the at least one of various information to which the user is allowed access comprises personal information which is selected from the group consisting of passport, visa, motor vehicle, immigration, work status and school status information.

10. A system for biometric identification, comprising:

a handheld biometric device, configured to receive a first user input used to determine whether to establish a foundational biometric measurement; and a terminal, configured to receive the established foundational biometric measurement from the handheld device, and also to receive a second user input from a user, and to determine whether to acknowledge a verifying measurement based on the established foundational biometric measurement and the second user input;

wherein the foundational biometric measurement expires based on passage of a set time period since establishment, regardless of whether there has been a successful acknowledgement of a verifying measurement;

wherein an authentication/establishment module is configured to establish another foundational biometric measurement after expiration, in response to another first user input;

wherein the first user input and second user input are inputted by the user;

wherein the set time period is preset by the user, based on the first user input;

wherein validation of a user transaction request at the terminal occurs when there is an acknowledgement of a corresponding verifying measurement;

wherein the user is allowed to complete a current transaction, if the user transaction request is validated before the foundational biometric measurement expires;

wherein the user being allowed to complete a current transaction comprises allowance of access to at least one of various information to the user; and wherein the foundational biometric measurement is established, based on the first user input, at least in response to utilization of biometric equipment by the user.

11. The system of claim 10, wherein whether the verifying measurement is biometric or non-biometric is defined by at least one of the group consisting of the user, a bank, a financial institution, a creditor, a credit reporting agency, a vendor, a retailer, an airport, a train station, a building operator, a credit institution, a law enforcement agency, and a government agency.

12. The system of claim 10, wherein the terminal is selected from the group consisting of a point of sale (POS) terminal, an entrance to a secured building, bank terminal, a credit terminal, a vendor terminal, a retail terminal, an airport security terminal, a train station security terminal, a law enforcement agency terminal, and a government agency terminal.

13. The system of claim 10, wherein a central administrator issues a decline order to the system for biometric authentication to reject transactions using the biometric handheld device in response to a user report.

14. The system of claim 10, wherein a fraudulent user is detained in response to rejection of a transaction.

15. The system of claim 10, further comprising at least one communication link to facilitate communication between the handheld biometric device, the terminal, and at least one backbone network.

* * * * *